US011761054B2

(12) United States Patent
Kim

(10) Patent No.: US 11,761,054 B2
(45) Date of Patent: Sep. 19, 2023

(54) WIRE ROD AND STEEL WIRE FOR SPRINGS HAVING EXCELLENT CORROSION FATIGUE RESISTANCE PROPERTIES, AND METHOD FOR PRODUCING SAME

(71) Applicant: POSCO, Pohang-si (KR)

(72) Inventor: Kwan-Ho Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 50 days.

(21) Appl. No.: 16/651,726

(22) PCT Filed: Sep. 13, 2018

(86) PCT No.: PCT/KR2018/010764
§ 371 (c)(1),
(2) Date: Mar. 27, 2020

(87) PCT Pub. No.: WO2019/066328
PCT Pub. Date: Apr. 4, 2019

(65) Prior Publication Data

US 2020/0255921 A1 Aug. 13, 2020

(30) Foreign Application Priority Data

Sep. 29, 2017 (KR) ..... 10-2017-0127263

(51) Int. Cl.

| | |
|---|---|
| ***C22C 38/02*** | (2006.01) |
| ***C21D 9/52*** | (2006.01) |
| ***C21D 6/00*** | (2006.01) |
| ***C21D 8/06*** | (2006.01) |
| ***C22C 38/00*** | (2006.01) |
| ***C22C 38/34*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/26*** | (2006.01) |
| ***C22C 38/24*** | (2006.01) |
| *C22C 38/04* | (2006.01) |
| *C22C 38/18* | (2006.01) |

(52) U.S. Cl.
CPC ..... *C21D 9/525* (2013.01); *C21D 6/004* (2013.01); *C21D 6/005* (2013.01); *C21D 6/008* (2013.01); *C21D 8/065* (2013.01); *C22C 38/001* (2013.01); *C22C 38/002* (2013.01); *C22C 38/24* (2013.01); *C22C 38/26* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/001* (2013.01); *C21D 2211/005* (2013.01); *C21D 2211/008* (2013.01); *C22C 38/02* (2013.01); *C22C 38/04* (2013.01); *C22C 38/18* (2013.01)

(58) Field of Classification Search
CPC ..... C21D 9/525
See application file for complete search history.

(56) References Cited

U.S. PATENT DOCUMENTS

| | | | | |
|---|---|---|---|---|
| 5,508,002 | A | 4/1996 | Kawaguchi et al. | |
| 8,734,599 | B2 * | 5/2014 | Choi | C21D 9/02 148/333 |
| 2006/0225819 | A1 | 10/2006 | Yoshihara | |
| 2007/0095439 | A1 | 5/2007 | Yoshihara | |
| 2010/0175795 | A1 | 7/2010 | Choi et al. | |
| 2011/0074076 | A1 | 3/2011 | Kuno et al. | |
| 2015/0101715 | A1 | 4/2015 | Takeda et al. | |

FOREIGN PATENT DOCUMENTS

| | | | |
|---|---|---|---|
| CN | 104321454 | A | 1/2015 |
| CN | 105051230 | A | 11/2015 |
| CN | 106756513 | A | 5/2017 |
| CN | 106987765 | A | 7/2017 |
| EP | 2832891 | A1 | 2/2015 |
| JP | H07-173577 | A | 7/1995 |
| JP | 2001-254145 | A | 9/2001 |
| JP | 2001-288539 | A | 10/2001 |
| JP | 2002194496 | A | 7/2002 |
| JP | 2005-023404 | A | 1/2005 |
| JP | 2006-183137 | A | 7/2006 |
| JP | 2006-291291 | A | 10/2006 |
| JP | 2008-190042 | A | 8/2008 |
| JP | 2009046763 | A | 3/2009 |
| JP | 2010-506052 | A | 2/2010 |
| JP | 2011-074431 | A | 4/2011 |
| JP | 2013-213238 | A | 10/2013 |
| JP | 2014-101569 | A | 6/2014 |
| JP | 2014-208900 | A | 11/2014 |
| JP | 2015-143391 | A | 8/2015 |
| KR | 10-2007-0047691 | A | 5/2007 |
| KR | 10-2011-0075318 | A | 7/2011 |
| KR | 10-1767838 | B1 | 8/2017 |

OTHER PUBLICATIONS

Japanese Office Action dated Jun. 1, 2021 issued in Japanese Patent Application No. 2020-517317.

(Continued)

*Primary Examiner* — Jophy S. Koshy
(74) *Attorney, Agent, or Firm* — Morgan, Lewis & Bockius LLP

(57) ABSTRACT

An embodiment of the present invention provides a wire rod and a steel wire which are for springs and have excellent corrosion fatigue resistance properties, and a method for producing same, the wire rod and steel wire containing, in wt %, 0.40-0.70% of C, 1.20-2.30% of Si, 0.20-0.80% of Mn, 0.20-0.80% of Cr, 0.015% or less of P, 0.015% or less of S, and 0.010% or less of N, with the remainder comprising Fe and other unavoidable impurities, along with at least one among 0.01-0.20% of V and 0.01-0.10% of Nb, wherein the V and Nb satisfy relational expression 1 below, the average grain size of prior austenite is no greater than 20 μm, and the surface decarburization depth is no greater than 0.1 mm. [Relational expression 1] [V]+[Nb]≥0.08 (where the V and Nb contents are in wt %).

10 Claims, 2 Drawing Sheets

(56) References Cited

OTHER PUBLICATIONS

International Search Report dated Dec. 19, 2018 issued in International Patent Application No. PCT/KR2018/010764 (with English translation).
Chinese Office Action dated Mar. 11, 2021 issued in Chinese Patent Application No. 201880063131.0.
Chinese Office Action dated Oct. 8, 2021, issued in corresponding Chinese Patent Application No. 201880063131.0.
Cheng Zhisong, "Innovative Technology and Equipment in Wire Rod and Bar Production", Metallurgical Industry Press, Oct. 31, 2016(Oct. 31, 2016), p. 119.

* cited by examiner

[FIG. 1]
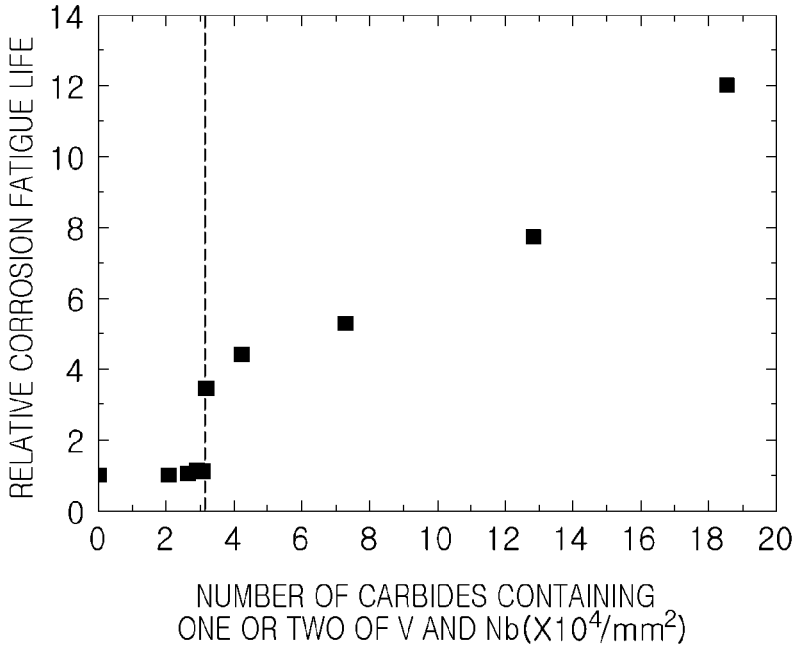

[FIG. 2]
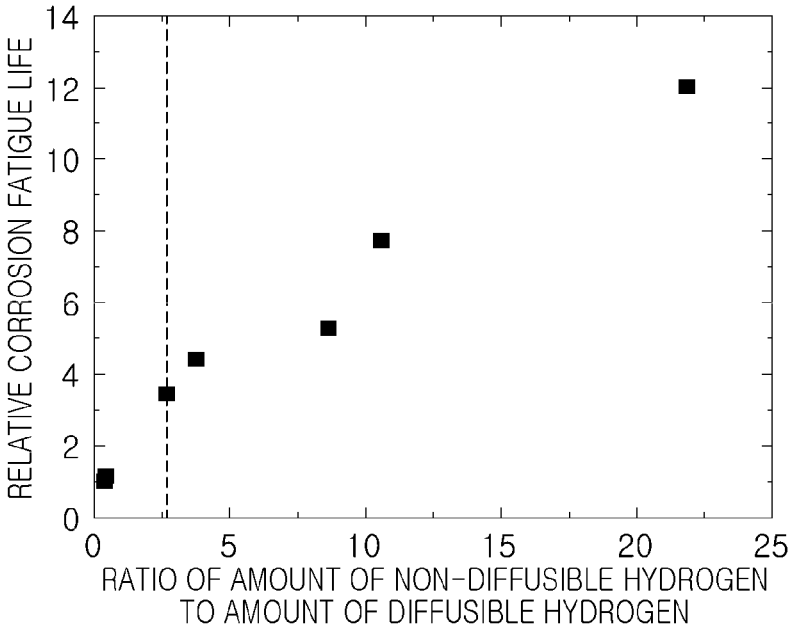

WIRE ROD AND STEEL WIRE FOR SPRINGS HAVING EXCELLENT CORROSION FATIGUE RESISTANCE PROPERTIES, AND METHOD FOR PRODUCING SAME

CROSS-REFERENCE OF RELATED APPLICATIONS

This application is the U.S. National Phase under 35 U.S.C. § 371 of International Patent Application No. PCT/KR2018/010764, filed on Sep. 13, 2018, which in turn claims the benefit of Korean Application No. 10-2017-0127263, filed on Sep. 29, 2017, the entire disclosures of which applications are incorporated by reference herein.

TECHNICAL FIELD

The present disclosure relates to a wire rod and a steel wire for springs having excellent corrosion fatigue resistance properties, and a method for producing the same, and more particularly, to a wire rod and a steel wire for springs capable of being applied to vehicle suspension springs, torsion bars, and stabilizers and having excellent corrosion fatigue resistance properties, and a method for producing the same.

BACKGROUND ART

In recent years, a demand for lightness of a material for a vehicle has greatly increased in order to improve fuel efficiency of a vehicle. In particular, a suspension spring has been designed to be manufactured using a high strength material having strength of 1800 MPa or higher after quenching and tempering in order to respond to the demand for the lightness.

A predetermined wire rod is produced through hot rolling by using steel for a spring, and then, in a case of a hot-rolled spring, a heating process, a forming process, and a quenching and tempering process are sequentially performed, and in a case of a cold-rolled spring, a drawing process and a quenching and tempering process are sequentially performed, thereby forming a spring.

In general, when high strength of a material is achieved, toughness is degraded and crack sensitivity is increased due to grain boundary embrittlement or the like. Thus, although the high strength of the material is achieved, when corrosion resistance of the material is degraded, a component that is exposed to the outside, such as a suspension spring of a vehicle, has a corrosion fit formed at a portion from which paint is peeled off. Therefore, the component may be damaged at an early stage due to fatigue cracks spreading from the corrosion fit.

In particular, a corrosive environment of a suspension spring becomes more severe due to an increase in spraying of a snow-melting agent used to prevent a road surface from freezing in winter. Therefore, a demand for steel for a spring having high strength and excellent corrosion fatigue resistance properties has increased.

Corrosion fatigue of a suspension spring is a phenomenon in which paint of a surface of the spring is peeled off by pebbles on a road surface or foreign matters, a material of a portion from which the paint is peeled off is exposed to outside to cause a pitting corrosion reaction, a generated corrosion pit is gradually grown, cracks are generated and spread from the corrosion pit, hydrogen flowing from the outside is concentrated on the cracks at some point to cause hydrogen embrittlement, and thus the spring is broken.

In order to improve corrosion fatigue resistance of a spring, a method of increasing types and contents of alloy elements has been used in the related art. In Patent Document 1, a content of Ni is increased to 0.55 wt % to improve corrosion resistance, thereby improving a corrosion fatigue life of a spring. In Patent Document 2, a content of Si is increased to obtain fine carbide to be precipitated during tempering, thereby increasing corrosion fatigue strength. In addition, in Patent Document 3, a Ti precipitate, which is a strong hydrogen trapping site, and V, Nb, Zr and Hf precipitates, which are weak hydrogen trapping sites, are adequately combined to improve hydrogen-delayed fracture resistance, thereby improving a corrosion fatigue life of a spring.

However, Ni is a very expensive element, and when a large amount of Ni is added, material costs increase. Since Si is a representative element that causes decarburization, an increase in content of Si may be significantly dangerous. Elements constituting a precipitate, such as Ti, V, and Nb, may degrade a corrosion fatigue life of a spring because the elements crystallize coarse carbonitrides from a liquid when the material is solidified.

Meanwhile, in order to increase strength of a spring, a method of adding an alloy element and a method of lowering a tempering temperature have been used in the related art. As the method of increasing strength of a spring by adding an alloy element, a method of increasing a quenching hardness by using C, Si, Mn, Cr, and the like is basically used. Strength of a steel material is increased through a rapid cooling and a tempering heat treatment by using Mo, Ni, V, Ti, Nb, and the like that are expensive alloy elements. However, in the case of these techniques, a cost price may increase.

In addition, a method of increasing strength of a steel material by changing heat treatment conditions in a general component system without changing of an alloy composition is used. That is, in a case where tempering is performed at a low temperature, the strength of the material is increased. However, when a tempering temperature is lowered, an area reduction rate of the material is decreased, which may cause degradation in toughness. As a result, a breakage during formation and use of the spring may occur at an early stage.

RELATED ART DOCUMENT (Patent Document 1) Japanese Patent Laid-Open Publication No. 2008-190042

(Patent Document 2) Japanese Patent Laid-Open Publication No. 2011-074431

(Patent Document 3) Japanese Patent Laid-Open Publication No. 2005-023404

DISCLOSURE

Technical Problem

An aspect of the present disclosure is to provide a wire rod and a steel wire for springs having excellent corrosion fatigue resistance properties, and a method for producing the same.

Technical Solution

According to an aspect of the present disclosure, there is provided a wire rod for a spring having an excellent corrosion fatigue resistance property, the wire rod containing: by wt %, C: 0.40 to 0.70%, Si: 1.20 to 2.30%, Mn: 0.20 to 0.80%, Cr: 0.20 to 0.80%, P: 0.015% or less, S: 0.015% or less, N: 0.010% or less, and a balance of Fe and other unavoidable impurities, wherein the wire rod further contains one or two of V: 0.01 to 0.20% and Nb: 0.01 to 0.10%, V and Nb satisfy the following Relational Expression 1, an average grain size of prior austenite is 20 μm or less, and a depth of surface decarburization is 0.1 mm or less.

$$[V]+[Nb]\geq 0.08 \text{ (where, a content of each of V and Nb refers to wt \%)} \quad \text{[Relational Expression 1]}$$

According to another aspect of the present disclosure, there is provided a method for producing a wire rod for a spring having an excellent corrosion fatigue resistance property, the method including: preparing a billet containing, by wt %, C: 0.40 to 0.70%, Si: 1.20 to 2.30%, Mn: 0.20 to 0.80%, Cr: 0.20 to 0.80%, P: 0.015% or less, S: 0.015% or less, N: 0.010% or less, and a balance of Fe and other unavoidable impurities, and further containing one or two of V: 0.01 to 0.20% and Nb: 0.01 to 0.10%, V and Nb satisfying the following Relational Expression 1; heating the billet at 900 to 1050° C.; finishing rolling and winding the heated billet at 800 to 1000° C. to obtain a wound coil; and performing primary cooling on the wound coil at a cooling rate of 2.0 to 10° C./s up to Ar1-40° C. and performing secondary cooling on the wound coil at a cooling rate of 0.3 to 1.8° C./s in a temperature range of (Ar1-40° C.) to (Ar1-140° C.).

$$[V]+[Nb]\geq 0.08 \text{ (where, a content of each of V and Nb refers to wt \%)} \quad \text{[Relational Expression 1]}$$

According to still another aspect of the present disclosure, there is provided a steel wire for a spring having an excellent corrosion fatigue resistance property, the steel wire containing: by wt %, C: 0.40 to 0.70%, Si: 1.20 to 2.30%, Mn: 0.20 to 0.80%, Cr: 0.20 to 0.80%, P: 0.015% or less, S: 0.015% or less, N: 0.010% or less, and a balance of Fe and other unavoidable impurities, wherein the steel wire further contains one or two of V: 0.01 to 0.20% and Nb: 0.01 to 0.10%, V and Nb satisfy the following Relational Expression 1, an average grain size of prior austenite is 20 μm or less, and a depth of surface decarburization is 0.1 mm or less.

$$[V]+[Nb]\geq 0.08 \text{ (where, a content of each of V and Nb refers to wt \%)} \quad \text{[Relational Expression 1]}$$

According to still another aspect of the present disclosure, there is provided a method for producing a steel wire for a spring having an excellent corrosion fatigue resistance property, the method including: heating, at 900 to 1050° C., a billet containing, by wt %, C: 0.40 to 0.70%, Si: 1.20 to 2.30%, Mn: 0.20 to 0.80%, Cr: 0.20 to 0.80%, P: 0.015% or less, S: 0.015% or less, N: 0.010% or less, and a balance of Fe and other unavoidable impurities, and further containing one or two of V: 0.01 to 0.20% and Nb: 0.01 to 0.10%, V and Nb satisfying the following Relational Expression 1; finishing rolling and winding the heated billet at 800 to 1000° C. to obtain a wound coil; performing primary cooling on the wound coil at a cooling rate of 2.0 to 10° C./s up to Ar1-40° C. and performing secondary cooling on the wound coil at a cooling rate of 0.3 to 1.8° C./s in a temperature range of (Ar1-40° C.) to (Ar1-140° C.) drawing the steel wire subjected to the primary and secondary cooling to obtain a steel wire; heating the steel wire at 850 to 1000° C. and holding the steel wire for 1 to 300 seconds; oil-cooling the heated and held steel wire up to 25 to 80° C.; and tempering the oil-cooled steel wire at 350 to 500° C.

$$[V]+[Nb]\geq 0.08 \text{ (where, a content of each of V and Nb refers to wt \%)} \quad \text{[Relational Expression 1]}$$

Advantageous Effects

As set forth above, according to an exemplary embodiment in the present disclosure, the amount of non-diffusible hydrogen with respect to the amount of diffusible hydrogen is increased, such that a wire rod and a steel wire for springs having excellent corrosion fatigue resistance properties, and a method for producing the same can be provided.

DESCRIPTION OF DRAWINGS

FIG. 1 is a graph illustrating a correlation between a relative corrosion fatigue life and the number of carbides containing 50 wt % or more of one or two of V and Nb in Inventive Examples 1 to 5 and Comparative Examples 1 to 5 according to an exemplary embodiment in the present disclosure.

FIG. 2 is a graph illustrating a correlation between a relative corrosion fatigue life and a ratio of the amount of non-diffusible hydrogen to the amount of diffusible hydrogen in Inventive Examples 1 to 5 and Comparative Examples 1 to 5 according to an exemplary embodiment in the present disclosure.

BEST MODE FOR INVENTION

The present inventors examined various influential factors affecting corrosion resistance of steel for a spring, and paid attention to that corrosion fatigue of a spring is a phenomenon in which a corrosion pit is generated due to peeling of paint of a surface of the spring, cracks are generated and spread from the corrosion pit, hydrogen flowing from the outside is concentrated on the cracks, and thus the spring is broken. Therefore, the present inventors were recognized that steel for a spring having excellent corrosion fatigue properties may be provided by controlling a microstructure, VC or NbC carbide for trapping hydrogen, or the like, thereby suggesting the present disclosure.

Hereinafter, the present disclosure will be described in detail. First, an alloy composition of the present disclosure will be described. A content of the alloy composition to be described below refers to wt %.

C: 0.40 to 0.70%

C is an essential element added to secure strength of a spring. In order to efficiently exert the effect thereof, a content of C is preferably 0.40% or more. On the other hand, when the content of C exceeds 0.70%, since a twin-type martensite structure is formed during a heat treatment in quenching and tempering and cracks of a material are thus generated, a fatigue life is significantly degraded, defect sensitivity is increase, and the fatigue life or a fracture stress is significantly degraded when a corrosion pit is generated. Therefore, an upper limit thereof is preferably 0.70%. Thus, the content of C is preferably 0.40 to 0.70%. A lower limit of the content of C is more preferably 0.45% and still more preferably 0.50%. The upper limit of the content of C is more preferably 0.65% and still more preferably 0.60%.

Si: 1.20 to 2.30%

Si is dissolved in ferrite to increase strength of a base material and to improve deformation resistance. However, when a content of Si is less than 1.20%, the effect of Si dissolved in ferrite to increase strength of a base material and to improve deformation resistance is insufficient. Therefore, a lower limit of the content of Si is required to be set to 1.20%. The content of Si is more preferably 1.40% or more. On the other hand, when the content of Si exceeds 2.30%, the effect of improving the deformation resistance is excessively exerted, and thus no effect is obtained from additional addition of Si, and surface decarburization occurs during a heat treatment. Therefore, the content of Si is preferably limited to 1.20 to 2.30%. Thus, the content of Si is preferably 1.20 to 2.30%. A lower limit of the content of Si is more preferably 1.40%. An upper limit of the content of Si is more preferably 2.20% and still more preferably 2.00%.

Mn: 0.20 to 0.80%

Mn is an element useful for improving hardenability of a steel material and thus securing strength of the steel material, when being contained in the steel material. Therefore, when a content of Mn is less than 0.20%, it is difficult to obtain sufficient strength and hardenability required for a material for a spring having high strength. On the other hand, when the content of Mn exceeds 0.80%, a hard structure may be easily generated during cooling after hot rolling due to an excessive increase in hardenability, and the corrosion fatigue resistance properties may be degraded due to an increase in generation of MnS inclusions. Thus, the content of Mn is preferably 0.20 to 0.80%. A lower limit of the content of Mn is more preferably 0.30% and still more preferably 0.35%. An upper limit of the content of Mn is more preferably 0.75%.

Cr: 0.20 to 0.80%

Cr is an element useful for preventing oxidation resistance, temper softening properties, and surface decarburization and securing hardenability. However, when a content of Cr is less than 0.20%, it is difficult to secure sufficient effects of the oxidation resistance, temper softening properties, surface decarburization, and hardenability. On the other hand, the content of Cr exceeds 0.80%, deformation resistance is degraded, which leads to a decrease in strength of the steel material. Thus, the content of Cr is preferably 0.20 to 0.80%. A lower limit of the content of Cr is more preferably 0.25% and still more preferably 0.30%. An upper limit of the content of Cr is more preferably 0.75% and still more preferably 0.70%.

Each of the wire rod and the steel wire according to the present disclosure preferably further contains one or two of V: 0.01 to 0.20% and Nb: 0.01 to 0.10%, in addition to the above alloy composition.

V: 0.01 to 0.20%

V is an element that improves strength of the steel material and contributes to grain refinement. V forms carbonitrides together with carbon (C) or nitrogen (N) and acts as a trap site for hydrogen infiltrating into steel. Further, V also serves to prevent hydrogen infiltration into a steel material and to reduce corrosion. Accordingly, in order to efficiently exert the effect thereof, a content of V is preferably 0.01% or more. However, when V is excessively added, since production costs increase, an upper limit of the content of V is preferably controlled to 0.20% or less. Thus, the content of V is preferably 0.01 to 0.20%. A lower limit of the content of V is more preferably 0.03% and still more preferably 0.05%. An upper limit of the content of V is more preferably 0.15% and still more preferably 0.13%.

Nb: 0.01 to 0.10%

Nb is an element that forms carbonitrides together with C or N, mainly contributes to structure refinement, and acts as a trap site for hydrogen. Accordingly, in order to efficiently exert the effect thereof, a content of Nb is preferably 0.01% or more. However, when the content of Nb is excessive, coarse carbonitrides are formed, and thus ductility of steel is degraded. Therefore, an upper limit of the content of Nb is preferably controlled to 0.10% or less. Thus, the content of Nb is preferably 0.01 to 0.10%. The upper limit of the content of Nb is more preferably 0.05% and still more preferably 0.03%.

P: 0.015% or Less

P is segregated into a grain boundary and degrades toughness. Thus, an upper limit of a content of P is preferably controlled to 0.015%. The content of P is more preferably 0.012% or less and still more preferably 0.010% or less.

S: 0.015% or Less

S is an element having a low melting point. S is segregated into a grain boundary, degrades toughness, and forms a large amount of MnS, which negatively affects the corrosion resistance properties. Thus, an upper limit of a content of S is preferably controlled to 0.015%. The content of S is more preferably 0.012% or less and still more preferably 0.010% or less.

N: 0.010% or Less

When a content of N is excessive, the amount of N dissolved in a matrix is increased, and thus drawability, fatigue properties, and spring formability are degraded. However, when the content of N is intended to be excessively small, cost problems occur. Thus, an upper limit of the content of N is preferably controlled to 0.010%. The content of N is more preferably 0.008% or less and still more preferably 0.006% or less.

A residual component of the alloy composition of the present disclosure is iron (Fe). However, since unintended impurities may be inevitably introduced from raw materials or surrounding environments in a typical steel manufacturing process, these impurities may not be excluded. Since these impurities in the typical steel manufacturing process are well-known to those skilled in the art, the entire contents thereof will not be specifically described in the present specification.

However, each of the wire rod and the steel wire according to the present disclosure may further contain one or two of Ti: 0.01 to 0.15% and Mo: 0.01 to 0.40%.

Ti: 0.01 to 0.15%

Ti is an element that forms carbonitrides to cause a precipitation hardening action and thus improves spring properties. Ti improves strength and toughness through grain refinement and precipitation reinforcement. In addition, Ti acts as a trap site for hydrogen infiltrating into steel, and thus Ti also serves to prevent hydrogen infiltration into a steel material and to reduce corrosion. When a content of Ti is less than 0.01%, it is not be effective due to low precipitation reinforcement and a low frequency of precipitations acting as a trap site for hydrogen. When the content of Ti exceeds 0.15%, production costs significantly increase, the effect of improving the spring properties by the precipitations is excessively exerted, and the amount of coarse alloy carbide which is not dissolved in a base material during a heat treatment of austenite is increased and thus the coarse alloy carbide acts as a non-metal inclusion. Accordingly, the fatigue properties and precipitation reinforcement effects are degraded. Thus, the content of Ti is preferably 0.01 to 0.15%. An upper limit of the content of Ti is more preferably 0.10% and still more preferably 0.15%.

Mo: 0.01 to 0.40%

Mo is an element that forms carbonitrides together with C or N, contributes to structure refinement, and acts as a trap site for hydrogen. Accordingly, in order to efficiently exert the effect thereof, a content of Mo is preferably 0.01% or more. However, when the content of Mo is excessive, a hard structure may be easily generated during cooling after hot rolling, and ductility of steel may be degraded due to formation of coarse carbonitrides. Thus, an upper limit of the content of Mo is preferably controlled to 0.40% or less. Thus, the content of Mo is preferably 0.01 to 0.40%. A lower limit of the content of Mo is more preferably 0.05%. The upper limit of the content of Mo is more preferably 0.30% and still more preferably 0.20%.

In addition, each of the wire rod and the steel wire according to the present disclosure may further contain one or two of Cu: 0.01 to 0.40% and Ni: 0.10 to 0.60%.

Cu: 0.01 to 0.40%

Cu is an element added in order to improve corrosion resistance. When a content of Cu is less than 0.01%, the above effect may be insufficient. On the other hand, it is not preferable that the content of Cu exceeds 0.40%, because, within this range, embrittlement is degraded during hot rolling, and thus cracks are generated. Thus, the content of Cu in the present disclosure is preferably limited to 0.01 to 0.40%. Therefore, the content of Cu is preferably 0.01 to 0.40%. A lower limit of the content of Cu is more preferably 0.05% and still more preferably 0.10%. An upper limit of the content of Cu is more preferably 0.35% and still more preferably 0.30%.

Ni: 0.10 to 0.60%

Ni is an element added in order to improve hardenability and toughness. When a content of Ni is less than 0.10%, the hardenability and toughness improvement effects are insufficient. On the other hand, it is not preferable that the content of Ni exceeds 0.60%, because, within this range, a fatigue life is reduced due to an increase in the amount of residual austenite, and production costs significantly increase due to expensive Ni. Thus, the content of Ni is preferably 0.10 to 0.60%. An upper limit of the content of Ni is more preferably 0.35% and still more preferably 0.30%.

In addition, in the wire rod and the steel wire according to the present disclosure, V and Nb preferably satisfy the following Relational Expression 1.

$$[V]+[Nb]\geq 0.08 \text{ (where, a content of each of V and Nb refers to wt \%.)} \quad \text{[Relational Expression 1]}$$

Examples of fine carbide capable of trapping hydrogen include VC, NbC, TiC, and MoC carbides that have V, Nb, Ti, and Mo, as a main component, respectively. Among them, Ti crystallizes TiN from a liquid before TiC is generated. Therefore, when TiN is coarsened, the hydrogen trapping effect is degraded, and corrosion resistance of a spring may be adversely affected. Accordingly, there is a great risk of using Ti-based carbide as main carbide for trapping hydrogen. In addition, Mo-based carbide is mainly generated at a temperature of 700° C. or lower and thus the Mo-based carbide is not easily controlled during producing of a wire rod. For this reason, main carbide capable of trapping hydrogen in the wire rod and steel wire for a spring is VC or NbC carbide that has V or Nb as a main component, respectively. Therefore, in the present disclosure, the corrosion fatigue resistance properties may be improved by setting the contents of V and Nb to satisfy Relational Expression 1.

More preferably, each of the wire rod and the steel wire includes $3.17\times10^4/mm^2$ or more of carbides containing 50 wt % or more of one or two of V and Nb. In order to prevent hydrogen flowing from the outside from being concentrated on the cracks, hydrogen is required to be trapped by fine carbides. Fine carbide that may be used in this case is VC or NbC carbide that has V or Nb as a main component, respectively, rather than cementite or TiC or MoC carbide. However, even in a case where VC or NbC carbide is included, when the number of VC or NbC carbide included is a predetermined number or less, the amount of hydrogen trapped by the carbide with respect to the amount of hydrogen included in steel is small, and thus the hydrogen trapping effect is degraded. Therefore, it is important to include the predetermined number of carbide. In the present disclosure, each of the wire rod and the steel wire includes $3.17\times10^4/mm^2$ or more of carbides containing 50 wt % or more of one or two of V and Nb, such that the hydrogen trapping effect may be maximized.

In addition, hydrogen in steel may be largely classified into diffusible hydrogen and non-diffusible hydrogen. The diffusible hydrogen refers to hydrogen that diffuses by a mechanical driving force or a chemical driving force that is generated from an external stress to cause hydrogen embrittlement. The non-diffusible hydrogen refers to hydrogen that does not diffuse by a driving force. The diffusible hydrogen, and the non-diffusible hydrogen may be distinguished by a thermal desorption analysis. In the thermal desorption analysis, the amount of hydrogen discharged from a material is measured while raising a temperature of the material, and in general, hydrogen discharged at a temperature of up to 300° C. is defined as diffusible hydrogen and hydrogen discharged at a temperature of 300° C. or higher is defined as non-diffusible hydrogen. In addition, when a temperature that is equal to or higher than activation energy is applied to a hydrogen trapping portion, a peak of the amount of hydrogen discharged is observed at a predetermined temperature. Accordingly, the hydrogen trapping portion in the material is indirectly inferred. In the thermal desorption analysis, the fact that the peak of discharged hydrogen is observed at 300° C. or higher means that hydrogen is trapped by fine carbide and then becomes non-diffusible hydrogen. If two or more peaks are observed at 300° C. or higher, it means that two or more carbides having different interfacial properties are included. Therefore, as a ratio of the amount of non-diffusible hydrogen trapped by fine carbide to diffusible hydrogen that causes embrittlement is increased, hydrogen embrittlement resistance is improved even when hydrogen infiltrates into a steel material.

Meanwhile, in the wire rod and the steel wire according to the present disclosure, an average grain size of prior austenite is preferably 20 μm or less. When the average grain size of the prior austenite exceeds 20 μm, toughness may be insufficient due to too coarse grain, and a spring may be suddenly fractured by slight corrosion due to degradation of corrosion resistance properties. In the present disclosure, as the average grain size of the prior austenite is small, it is advantageous to secure excellent physical properties. Therefore, a lower limit thereof is not particularly limited.

In addition, a depth of surface decarburization is preferably 0.1 mm or less. When the depth of the surface decarburization exceeds 0.1 mm, a hardness of a surface portion is reduced, and thus corrosion fatigue resistance properties of a spring are degraded.

Meanwhile, a microstructure of the wire rod according to the present disclosure is preferably a composite structure of ferrite and pearlite. As such, by controlling the microstructure, excellent drawability after hot rolling may be secured. In addition, a fraction of the ferrite is preferably 5 to 35 area %. When the fraction of the ferrite is less than 5 area %, drawability may be degraded. When the fraction of the ferrite exceeds 35 area %, the wire rod is too softened, and thus strength of the steel wire or a spring product may be insufficient.

Meanwhile, the microstructure of the steel wire according to the present disclosure is preferably formed of 10% or less of residual austenite and remaining tempered martensite in an area fraction. When the fraction of the residual austenite exceeds 10 area %, strength of the steel wire is significantly reduced. Further, the residual austenite may be transformed into martensite while a spring is mounted and used, and thus the spring may be suddenly fractured.

In the wire rod and the steel wire according to the present disclosure that are provided as described above, a ratio of the amount of non-diffusible hydrogen to the amount of diffusible hydrogen may be 2.67 or more. Accordingly, excellent corrosion fatigue resistance properties may be implemented.

Hereinafter, an exemplary embodiment of a production method according to the present disclosure will be described.

First, a billet having the alloy composition described above is preferably heated at 900 to 1050° C. The heating temperature of the billet is set to 900° C. or higher to melt all coarse carbides that may be generated during casting and thus to uniformly distribute the alloy elements in austenite. However, when the heating temperature of the billet is higher than 1050° C., a grain size of austenite may be rapidly coarsened.

Thereafter, it is preferable that the heated billet is subjected to finishing rolling and winding at 800 to 1000° C. to obtain a wound coil. The finishing rolling temperature is set to 800° C. or higher to promote precipitation of fine carbide. When the finishing rolling temperature is lower than 800° C., a load of a rolling roll may be increased. On the other hand, when the finishing rolling temperature is higher than 1000° C., it takes a long time to perform cooling, and thus decarburization may be severe even though a cooling rate is controlled.

Subsequently, it is preferable that the wound coil is subjected to primary cooling at a cooling rate of 2.0 to 10° C./s up to Ar1-40° C., and then is subjected to secondary cooling at a cooling rate of 0.3 to 1.8° C./s in a temperature range of (Ar1-40° C.) to (Ar1-140° C.). The cooling condition is controlled as described above because a hard structure such as bainite or martensite may be generated without completion of transform of pearlite after generation of ferrite, and decarburization may be severe. Further, it is because, when a hard structure is generated during cooling, a material may be broken or may be difficult to be drawn during a drawing process of a wire material to obtain a steel wire for a spring having an adequate diameter. In addition, when decarburization is severe, a hardness of a surface portion is reduced and then the corrosion fatigue resistance properties of the spring are degraded.

Since a temperature range in which decarburization occurs most actively is a two-phase range of austenite and ferrite (Ar3 to Ar1 temperature range), in order to minimize a time passing through the temperature range, it is preferable that the primary cooling is performed at a fast cooling rate within the temperature range between the winding temperature and Ar1-40° C. The primary cooling rate is preferably 2.0° C./s or more, and within this range, a depth of decarburization may be decreased. On the other hand, when the primary cooling rate exceeds 10° C./s, a hard structure such as martensite or bainite may be generated. Therefore, the primary cooling rate is preferably controlled to a range of 2.0 to 10° C./s.

In addition, after the primary cooling, the secondary cooling is preferably performed at a relatively slow cooling rate within the temperature range of (Ar1-40° C.) to (Ar1-140° C.). The secondary cooling rate is preferably 0.3 to 1.8° C./s. Within this range, a time required for transforming pearlite is sufficiently secured, and thus a structure formed of only ferrite and pearlite may be obtained without generation of bainite or martensite. When the secondary cooling rate exceeds 1.8° C./s, a hard structure such as bainite or martensite may be generated. When the secondary cooling rate is less than 0.3° C./s, it takes a long time to perform cooling, and thus decarburization may be severe.

A wire rod having excellent corrosion fatigue resistance properties that is provided by the present disclosure may be obtained through the production condition as described above. In order to obtain a steel wire, it is preferable that a production is performed under an additional condition to be described below.

After a steel wire is obtained by drawing the wire rod obtained as described above, it is preferable that the steel wire is heated at 850 to 1000° C. and held for 1 to 300 seconds. When the heating temperature is lower than 850° C., pearlite that is not dissolved may remain and thus strength of the steel wire may be insufficient. When the heating temperature is higher than 1000° C., a grain size of austenite of the steel wire may be coarsened.

Meanwhile, recently, induction heat treatment facilities are often used to produce a steel wire for a spring. When the heating holding time is shorter than 1 second, carbide, ferrite, and pearlite may not be sufficiently heated and may thus not be transformed into austenite. On the other hand, when the heating holding time is longer than 300 seconds, decarburization may be severe or a grain of austenite may be coarsened. Therefore, the heating holding time is preferably in a range of 1 to 300 seconds.

It is preferable that the heated and held steel wire is oil-cooled to 25 to 80° C. When an oil-cooling stop temperature is lower than 25° C., since the oil-cooling stop temperature needs to be lowered than the room temperature, a cooling capability or a cooling facility may be additionally supplemented. When the oil-cooling stop temperature is higher than 80° C., since the amount of remaining austenite is too large, it is disadvantageous in that austenite may exceed 10 area %.

Subsequently, the oil-cooled steel wire is preferably tempered at 350 to 500° C. When the tempering temperature is lower than 350° C., toughness is not secured, and thus a breakage may occur during formation of the steel wire or in a product state. When the tempering temperature is higher than 500° C., strength of the steel wire may be reduced. The steel wire for a spring produced under the above condition may secure mechanical properties desired in the present disclosure.

MODE FOR INVENTION

Hereinafter, the present disclosure will be described in detail with reference to examples. However, the following examples are merely examples for describing the present disclosure in more detail, but do not limit the scope of the present disclosure.

EXAMPLES

A billet having an alloy composition shown in Table 1 was prepared, the billet was heated at 980° C., the heated billet was subjected to finishing rolling and winding at 850° C., and then cooling was performed under conditions shown in Table 2, thereby obtaining a wire rod. A microstructure and a depth of decarburization of the wire rod were measured, and the results are shown in Table 2. In addition, a steel wire was produced by drawing the wire rod obtained as described above, heating was performed at 975° C. and held for 15 minutes, the steel wire was immersed in oil of 70° C. and then rapidly cooled, and then tempering was performed at 390° C. for 30 minutes. For the steel wire produced as described above, a ratio of the amount of non-diffusible hydrogen to the amount of diffusible hydrogen, a relative corrosion fatigue life (compared to Comparative Example 1), and tensile strength were measured by a precipitation fraction and a thermal desorption analysis, and the results are shown in Table 2.

The number of carbides containing 50 wt % or more of one or two of V and Nb per unit area was measured by cutting a cross-section of the produced steel wire and extracting fine carbide by a replica method with a transmission electron microscope and energy dispersive X-ray spectroscopy.

The ratio of the amount of non-diffusible hydrogen to the amount of diffusible hydrogen was measured by using the amount of hydrogen discharged while heating the heated steel wire for a spring at a temperature raising rate of 100° C./hr up to 800° C. with quadruple mass spectrometry.

A cycle in which the steel wire was put into a salt water spray tester, 5% salt water was sprayed at an atmosphere of 35° C. for 4 hours, the steel wire was dried at an atmosphere of a temperature of 25° C. and a humidity of 50% for 4 hours, and the steel wire was wet at an atmosphere of 40° C. for 16 hours until the humidity became 100% was repeated 14 times, and then a rotary bending fatigue test was performed, thereby measuring the corrosion fatigue life. A speed of the fatigue test was 3,000 rpm, a weight applied to the sample was 40% of the tensile strength, 10 samples were tested, an average value of fatigue lives of 8 samples excluding the sample having the highest fatigue life and the sample having the lowest fatigue life was calculated, and the obtained average value was determined as a corrosion fatigue life of the sample.

TABLE 1

| | Alloy composition (wt %) | | | | | | | | | | | | | |
|---|---|---|---|---|---|---|---|---|---|---|---|---|---|---|
| Classification | C | Si | Mn | Cr | V | Nb | Ti | Mo | Cu | Ni | P | S | N | V + Nb |
| Comparative Steel 1 | 0.54 | 1.48 | 0.62 | 0.59 | — | — | — | — | — | — | 0.011 | 0.005 | 0.041 | — |
| Comparative Steel 2 | 0.54 | 1.48 | 0.58 | 0.62 | 0.05 | — | — | — | — | 0.25 | 0.010 | 0.007 | 0.049 | 0.05 |
| Comparative Steel 3 | 0.61 | 1.52 | 0.43 | 0.26 | — | 0.02 | — | — | 0.21 | 0.12 | 0.009 | 0.008 | 0.0045 | 0.02 |
| Comparative Steel 4 | 0.45 | 1.45 | 0.66 | 0.46 | — | 0.02 | 0.10 | 0.11 | 0.25 | 0.24 | 0.011 | 0.010 | 0.0050 | 0.02 |
| Comparative Steel 5 | 0.52 | 1.68 | 0.51 | 0.38 | 0.06 | — | 0.02 | 0.12 | 0.24 | 0.51 | 0.007 | 0.003 | 0.0042 | 0.06 |
| Inventive steel 1 | 0.55 | 1.41 | 0.68 | 0.69 | 0.09 | — | — | — | — | — | 0.010 | 0.004 | 0.0051 | 0.09 |
| Inventive steel 2 | 0.51 | 1.50 | 0.31 | 0.65 | 0.11 | 0.03 | 0.02 | — | — | — | 0.008 | 0.005 | 0.0058 | 0.14 |
| Comparative Steel 6 | 0.36 | 1.51 | 0.89 | 0.63 | 0.07 | — | — | 0.10 | — | — | 0.011 | 0.005 | 0.0049 | 0.07 |
| Comparative Steel 7 | 0.52 | 2.46 | 0.53 | 0.15 | — | 0.04 | 0.03 | 0. 05 | 0.11 | 0.25 | 0.011 | 0.006 | 0.0045 | 0.04 |
| Inventive steel 3 | 0.53 | 2.08 | 0.65 | 0.67 | 0.15 | — | — | — | — | — | 0.009 | 0.006 | 0.0046 | 0.15 |
| Inventive steel 4 | 0.50 | 1.49 | 0.41 | 0.34 | 0.06 | 0.02 | — | 0.10 | 0.20 | 0.22 | 0.007 | 0.006 | 0.0042 | 0.08 |
| Inventive steel 5 | 0.64 | 1.55 | 0.33 | 0.27 | 0.09 | 0.05 | — | — | 0.16 | 0.46 | 0.010 | 0.005 | 0.0046 | 0.14 |
| Inventive steel 6 | 0.51 | 1.47 | 0.51 | 0.31 | 0.04 | 0.08 | 0.03 | 0.19 | 0.23 | 0.26 | 0.011 | 0.007 | 0.0044 | 0.12 |
| Inventive steel 7 | 0.49 | 1.62 | 0.32 | 0.29 | 0.08 | 0.02 | — | 0.12 | 0.16 | 0.18 | 0.007 | 0.004 | 0.0041 | 0.1 |

TABLE 2

| | | Cooling rate (° C./s) | | Average grain | Presence | |
|---|---|---|---|---|---|---|
| Classification | Steel type No. | Winding temperature to (Ar1-40° C.) | (Ar1-40° C.) to (Ar1-140° C.) | size of prior austenite (μm) | or absence of hard structure | Ferrite fraction (area %) |
| Comparative Example 1 | Comparative Steel 1 | 1.7 | 1.2 | 22 | x | 6 |
| Comparative Example 2 | Comparative Steel 2 | 2.2 | 2.6 | 24 | ○ | 4 |
| Comparative Example 3 | Comparative Steel 3 | 0.7 | 2.4 | 22 | ○ | 2 |
| Comparative Example 4 | Comparative Steel 4 | 1.9 | 0.2 | 20 | x | 10 |
| Comparative Example 5 | Comparative Steel 5 | 1.0 | 3.4 | 21 | ○ | 7 |
| Comparative Example 6 | Inventive steel 1 | 0.9 | 0.2 | 21 | ○ | 0 |
| Comparative Example 7 | Inventive steel 2 | 1.8 | 1.2 | 23 | ○ | 5 |

TABLE 2-continued

| | | | | | | |
|---|---|---|---|---|---|---|
| Comparative Example 8 | Comparative Steel 6 | 2.4 | 0.5 | 22 | ○ | 4 |
| Comparative Example 9 | Comparative Steel 7 | 2.1 | 1.6 | 26 | ○ | 1 |
| Inventive Example 1 | Inventive steel 3 | 2.1 | 1.6 | 20 | x | 12 |
| Inventive Example 2 | Inventive steel 4 | 2.1 | 1.8 | 17 | x | 14 |
| Inventive Example 3 | Inventive steel 5 | 2.5 | 0.4 | 10 | x | 25 |
| Inventive Example 4 | Inventive steel 6 | 3.1 | 0.7 | 12 | x | 21 |
| Inventive Example 5 | Inventive steel 7 | 2.0 | 1.2 | 13 | x | 31 |

| Classification | Steel type No. | Decarburization depth (mm) | Number of carbides containing one or two of V and Nb (×10 Vmm$^2$) | Ratio of amount of non-diffusible hydrogen to amount of diffusible hydrogen | Relative corrosion fatigue life | Tensile strength of steel wire (MPa) |
|---|---|---|---|---|---|---|
| Comparative Example 1 | Comparative Steel 1 | 0.15 | 0 | 0.39 | 1.00 | 1926 |
| Comparative Example 2 | Comparative Steel 2 | 0.12 | 3.05 | 0.42 | 1.12 | 1953 |
| Comparative Example 3 | Comparative Steel 3 | 0.22 | 2.64 | 0.41 | 1.05 | 1957 |
| Comparative Example 4 | Comparative Steel 4 | 0.14 | 2.07 | 0.38 | 1.01 | 2004 |
| Comparative Example 5 | Comparative Steel 5 | 0.17 | 2.92 | 0.43 | 1.14 | 1996 |
| Comparative Example 6 | Inventive steel 1 | 0.19 | 3.12 | 1.27 | 1.03 | 1874 |
| Comparative Example 7 | Inventive steel 2 | 0.14 | 3.53 | 1.44 | 1.22 | 1922 |
| Comparative Example 8 | Comparative Steel 6 | 0.12 | 2.18 | 1.63 | 1.07 | 1744 |
| Comparative Example 9 | Comparative Steel 7 | 0.16 | 1.45 | 0.89 | 0.96 | 1875 |
| Inventive Example 1 | Inventive steel 3 | 0.10 | 3.17 | 2.67 | 3.45 | 1972 |
| Inventive Example 2 | Inventive steel 4 | 0.08 | 4.21 | 3.78 | 4.41 | 1937 |
| Inventive Example 3 | Inventive steel 5 | 0.05 | 12.83 | 10.62 | 7.73 | 2018 |
| Inventive Example 4 | Inventive steel 6 | 0.07 | 7.29 | 8.63 | 5.27 | 2033 |
| Inventive Example 5 | Inventive steel 7 | 0.03 | 18.54 | 21.84 | 12.05 | 205 |

As shown in Tables 1 and 2, it was confirmed that, in Inventive Examples 1 to 5 that satisfy the alloy composition and the production conditions of the present disclosure, all the microstructure, the depth of the surface decarburization, and the fraction of carbide containing 50 wt % or more of one or two of V and Nb, and the like that are suggested by the present disclosure were satisfied, and thus the excellent ratio of the amount of non-diffusible hydrogen to the amount of diffusible hydrogen and the excellent corrosion fatigue life were exhibited.

However, it could be appreciated that, in Comparative Examples 1 to 5 that do not satisfy the alloy composition and the production conditions of the present disclosure, the conditions such as the fraction of the microstructure and the depth of the surface decarburization were not satisfied, the fraction of carbide containing 50 wt % or more of one or two of V and Nb was $3.05\times10^4$/mm$^2$ or less, and, accordingly, the ratio of the amount the non-diffusible hydrogen to the amount of diffusible hydrogen was 0.38 to 0.43, which is low as compared in Inventive Examples 1 to 5. In addition, it could be appreciated that the relative corrosion fatigue life was 1.00 to 1.14, which is significantly low as compared in Inventive Examples 1 to 5 having 3.45 to 12.05 of the relative corrosion fatigue life.

It could be appreciated that, in Comparative Examples 6 and 7 that satisfy the alloy composition of the present disclosure but do not satisfy the production conditions of the present disclosure, the average grain size of the prior austenite exceeded the range suggested by the present disclosure, the hard structure such as bainite or martensite was generated, a large amount of decarburization occurred, the ratio of the amount the non-diffusible hydrogen to the amount of diffusible hydrogen was small, and thus the relative corrosion fatigue life was very insufficient.

It could be confirmed that, in Comparative Examples 8 and 9 that satisfy the production conditions of the present disclosure but do not satisfy the alloy composition of the present disclosure, the average grain size of the prior austenite exceeded the range suggested by the present disclosure, the fraction of ferrite was not satisfied, the hard structure was generated, and the depth of the decarburization was large. In addition, it could be appreciated that the faction of carbide containing 50 wt % or more of one or two of V and Nb was not satisfied, the ratio of the amount the non-diffusible hydrogen to the amount of diffusible hydrogen was small, and thus the relative corrosion fatigue life was very insufficient.

FIG. 1 is a graph illustrating a correlation between a relative corrosion fatigue life and the number of carbides containing 50 wt % or more of one or two of V and Nb in Inventive Examples 1 to 5 and Comparative Examples 1 to 5. As illustrated in FIG. 1, it could be appreciated that, in the case where the fraction of carbide containing 50 wt % or more of one or two of V and Nb was $3.17\times10^4/mm^2$ or more, which is the condition of the present disclosure, the relative corrosion fatigue life was excellent.

FIG. 2 is a graph illustrating a correlation between a relative corrosion fatigue life and a ratio of the amount of non-diffusible hydrogen to the amount of diffusible hydrogen in Inventive Examples 1 to 5 and Comparative Examples 1 to 5. As illustrated in FIG. 2, it could be appreciated that, in the case where the ratio of the amount the non-diffusible hydrogen to the amount of diffusible hydrogen was 2.67 or more, the relative corrosion fatigue life was excellent.

The invention claimed is:

1. A wire rod for a spring, the wire rod containing: by wt %, C: 0.40 to 0.70%, Si: 1.20 to 2.30%, Mn: 0.20 to 0.80%, Cr: 0.20 to 0.80%, P: 0.015% or less, S: 0.015% or less, N: 0.010% or less, one or two of V: 0.01 to 0.20% and Nb: 0.01 to 0.10%, and a balance of Fe and other unavoidable impurities, wherein Relational Expression 1: [V]+[Nb]≥0.08 is satisfied, wherein, [V] and [Nb] represent the content of V and Nb in wt %, wherein a microstructure of the wire rod is a composite structure of ferrite and pearlite, and a fraction of the ferrite is 5 to 35 area %, a ratio of an amount of non-diffusible hydrogen to an amount of diffusible hydrogen is 2.67 or more, an average grain size of prior austenite is 20 μm or less, a depth of surface decarburization is 0.1 mm or less, and the wire rod includes $3.17\times10^4/mm^2$ or more of carbides containing 50 wt % or more of one or two of V and Nb.

2. A steel wire for a spring, the steel wire containing: by wt %, C: 0.40 to 0.70%, Si: 1.20 to 2.30%, Mn: 0.20 to 0.80%, Cr: 0.20 to 0.80%, P: 0.015% or less, S: 0.015% or less, N: 0.010% or less, one or two of V: 0.01 to 0.20% and Nb: 0.01 to 0.10%, and a balance of Fe and other unavoidable impurities, wherein Relational Expression 1: [V]+[Nb]≥0.08 is satisfied, wherein [V] and [Nb] represent the content of V and Nb in wt %, a ratio of an amount of non-diffusible hydrogen to an amount of diffusible hydrogen is 2.67 or more, an average grain size of prior austenite is 20 μm or less, a depth of surface decarburization is 0.1 mm or less, the steel wire includes $3.17\times10^4/mm^2$ or more of carbides containing 50 wt % or more of one or two of V and Nb, and a microstructure of the steel wire is, in an area fraction, 10% or less of residual austenite and remaining tempered martensite.

3. The wire rod of claim 1, further containing by wt %, one or two of Ti: 0.01 to 0.15% and Mo: 0.01 to 0.40%.

4. The wire rod of claim 1, further containing by wt %, one or two of Cu: 0.01 to 0.40% and Ni: 0.10 to 0.60%.

5. The wire rod of claim 1, wherein the wire rod contains, by wt %, Si: 1.20 to 1.49%.

6. The steel wire of claim 2, further containing by wt %, one or two of Ti: 0.01 to 0.15% and Mo: 0.01 to 0.40%.

7. The steel wire of claim 2, further containing by wt %, one or two of Cu: 0.01 to 0.40% and Ni: 0.10 to 0.60%.

8. A method for producing the wire rod of claim 1, the method comprising:

heating, at 900 to 1050° C., a billet containing, by wt %, C: 0.40 to 0.70%, Si: 1.20 to 2.30%, Mn: 0.20 to 0.80%, Cr: 0.20 to 0.80%, P: 0.015% or less, S: 0.015% or less, N: 0.010% or less, and a balance of Fe and other unavoidable impurities, and further containing one or two of V: 0.01 to 0.20% and Nb: 0.01 to 0.10%, V and Nb satisfying the Relational Expression 1;

finishing rolling and winding the heated billet at 800 to 1000° C. to obtain a wound coil; and performing primary cooling on the wound coil at a cooling rate of 2.0 to 10° C./s up to Ar1-40° C. and performing secondary cooling on the wound coil at a cooling rate of 0.3 to 1.8° C./s in a temperature range of (Ar1-40° C.) to (Ar1-140° C.).

9. The method of claim 8, wherein the billet further contains, by wt %, one or two of Ti: 0.01 to 0.15% and Mo: 0.01 to 0.40%.

10. The method of claim 8, wherein the billet further contains, by wt %, one or two of Cu: 0.01 to 0.40% and Ni: 0.10 to 0.60%.

* * * * *